US006374496B1

(12) United States Patent
Hsu

(10) Patent No.: US 6,374,496 B1
(45) Date of Patent: Apr. 23, 2002

(54) STRUCTURE ART DESIGN KNIFE

(76) Inventor: Cheng-Hui Hsu, No. 126, Pao Chung Road, Hsin Tien City, Taipei Hsien (TW)

( * ) Notice: Subject to any disclaimer, the term of this patent is extended or adjusted under 35 U.S.C. 154(b) by 0 days.

(21) Appl. No.: 09/765,568

(22) Filed: Jan. 22, 2001

(51) Int. Cl.[7] ..... B26B 1/08
(52) U.S. Cl. ..... 30/162; 30/125; 30/340
(58) Field of Search ..... 30/162, 340, 125, 30/335

(56) References Cited

U.S. PATENT DOCUMENTS 4,517,741 A * 5/1985 Castelluzzo ..... 30/162
5,435,062 A * 7/1995 Huang ..... 30/162 X
5,509,205 A * 4/1996 Ragland ..... 30/162
5,870,828 A * 2/1999 Polites ..... 30/162
6,192,589 B1 * 2/2001 Martone et al. ..... 30/162 X
6,223,439 B1 * 5/2001 Wonderly ..... 30/162
6,249,975 B1 * 6/2001 Lin ..... 30/162

* cited by examiner

*Primary Examiner*—Douglas D. Watts
(74) *Attorney, Agent, or Firm*—Rosenberg, Klein & Lee

(57) ABSTRACT

An improved structure art design knife comprised of a front cover, a rear cover, an upper support cushion, a lower support cushion, a blade magazine section, and a blade arrestor section. In addition to providing for convenient blade replacement, the blade magazine section contains a quantity of spare blades to thereby increase art design knife efficiency and, furthermore, enhance the industrial practical value of art design knife structures.

1 Claim, 11 Drawing Sheets

STRUCTURE ART DESIGN KNIFE

BACKGROUND OF THE INVENTION

1) Field of the Invention

The invention herein relates to an improved structure art design knife providing for the safer and firmer manual wielding of an art design knife that is comprised of a front cover, a rear cover, an upper support cushion, a lower support cushion, a blade magazine section, and a blade arrestor section; in addition to providing for convenient blade replacement, the magazine section of the present invention contains a quantity of spare blades to thereby increase art design knife efficiency and, furthermore, enhance the industrial practical value of art design knife structures.

2) Description of the Prior Art

Conventional art design knives typically have internally disposed extension/retraction devices, wherein the wear that normally occurs between a keeper spring and a single-sided wave-contoured engagement slot diminishes stationary nesting capability, which during utilization results in the incapability of maintaining the fixed positioning of the blade and easily causes dangerous wounds. Furthermore, since the spare blades of conventional art design knives are kept external from the body of the implement itself, when a blade is to be replaced, a considerable amount of time is often wasted locating the spare blades. In view of the existent shortcomings of the conventional product still awaiting improvement, the inventor of the invention herein based on specialized knowledge and design experience gained by engagement in the related fields conducted extensive research inspired by an original idea that culminated in the successful design of the improved structure art design knife of the present invention.

SUMMARY OF THE INVENTION

The objective of the invention herein is to provide an improved structure art design knife in which the push button, the blade changing key, and the blade mount are solidly, efficiently, and precisely engaged in the wave-contoured stepped slot of the front cover, effectively reinforcing the immovability of the blade and thereby increasing its safety; furthermore, the blade magazine section of the invention herein contains a quantity of spare blades and is physically integrated with the body of the art design knife to further facilitate blade replacement convenience.

To enable the examination committee to further understand the advantages, objectives, and functions of the present invention, the preferred embodiments of the invention herein accompanied by the brief description of the drawings below and followed by the detailed description of the invention herein.

DETAILED DESCRIPTION OF THE INVENTION

Figure 1:
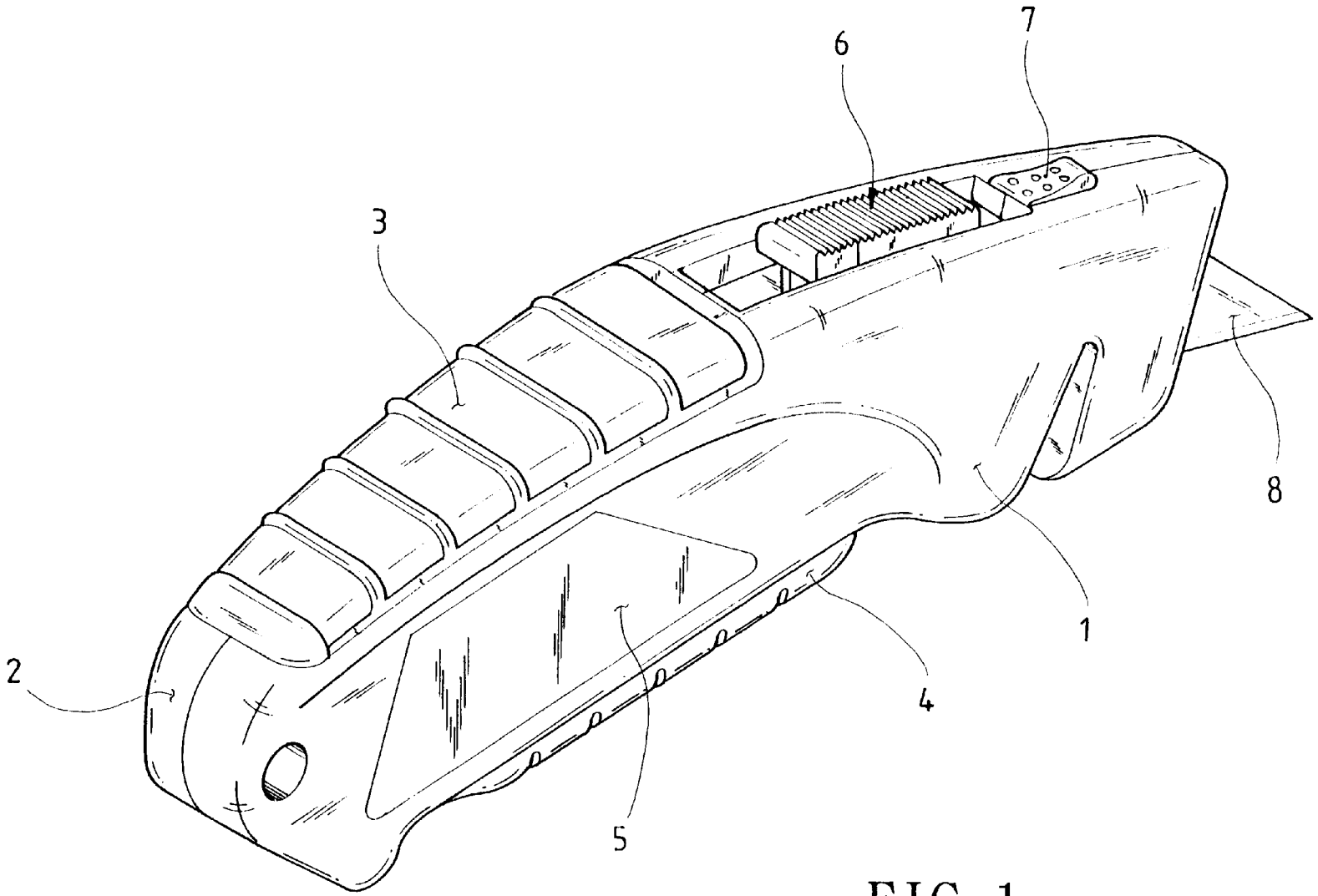
FIG. 1 is an isometric drawing of the invention herein.
Figure 2:
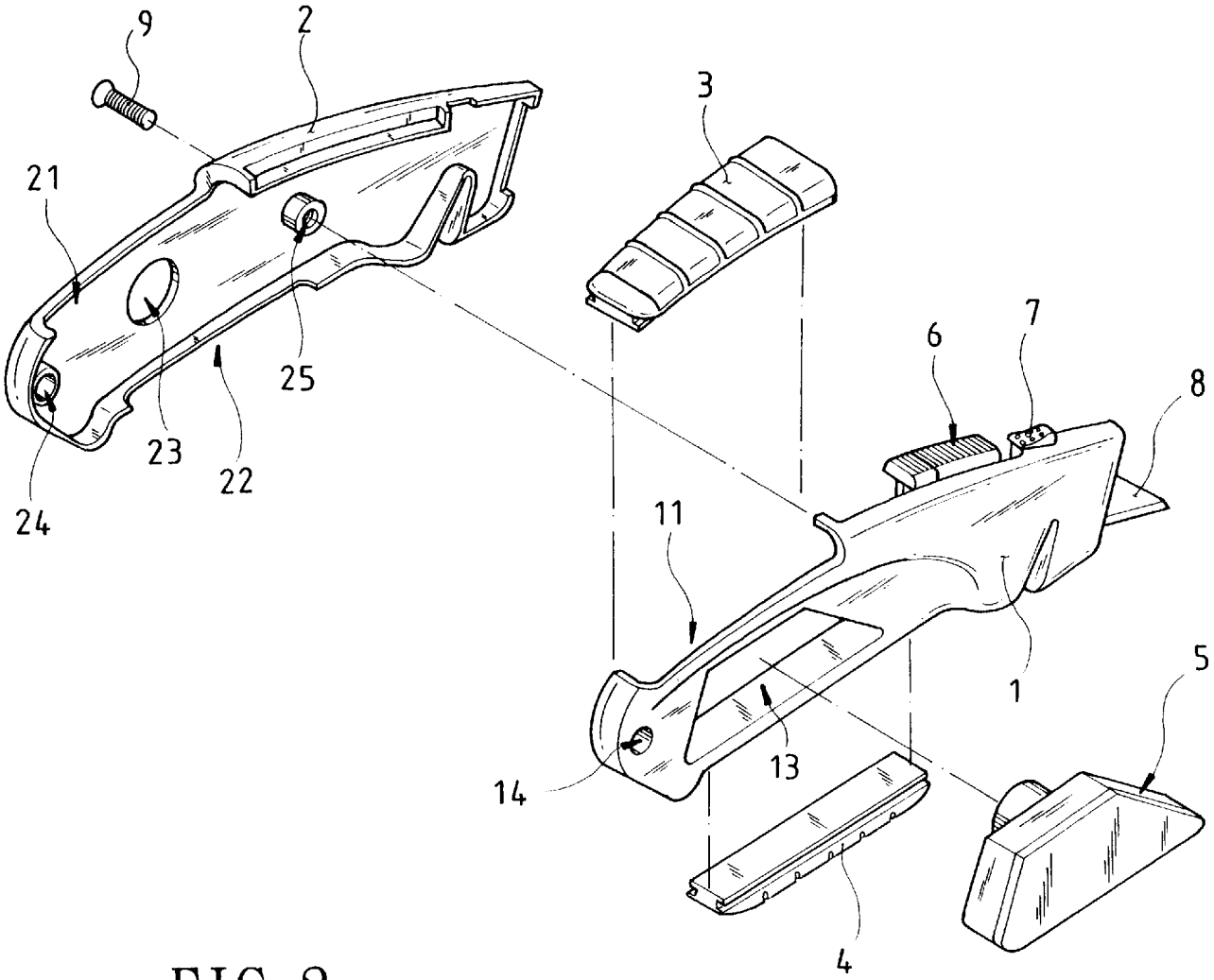
FIG. 2 is an exploded drawing of the invention herein.
Figure 9:
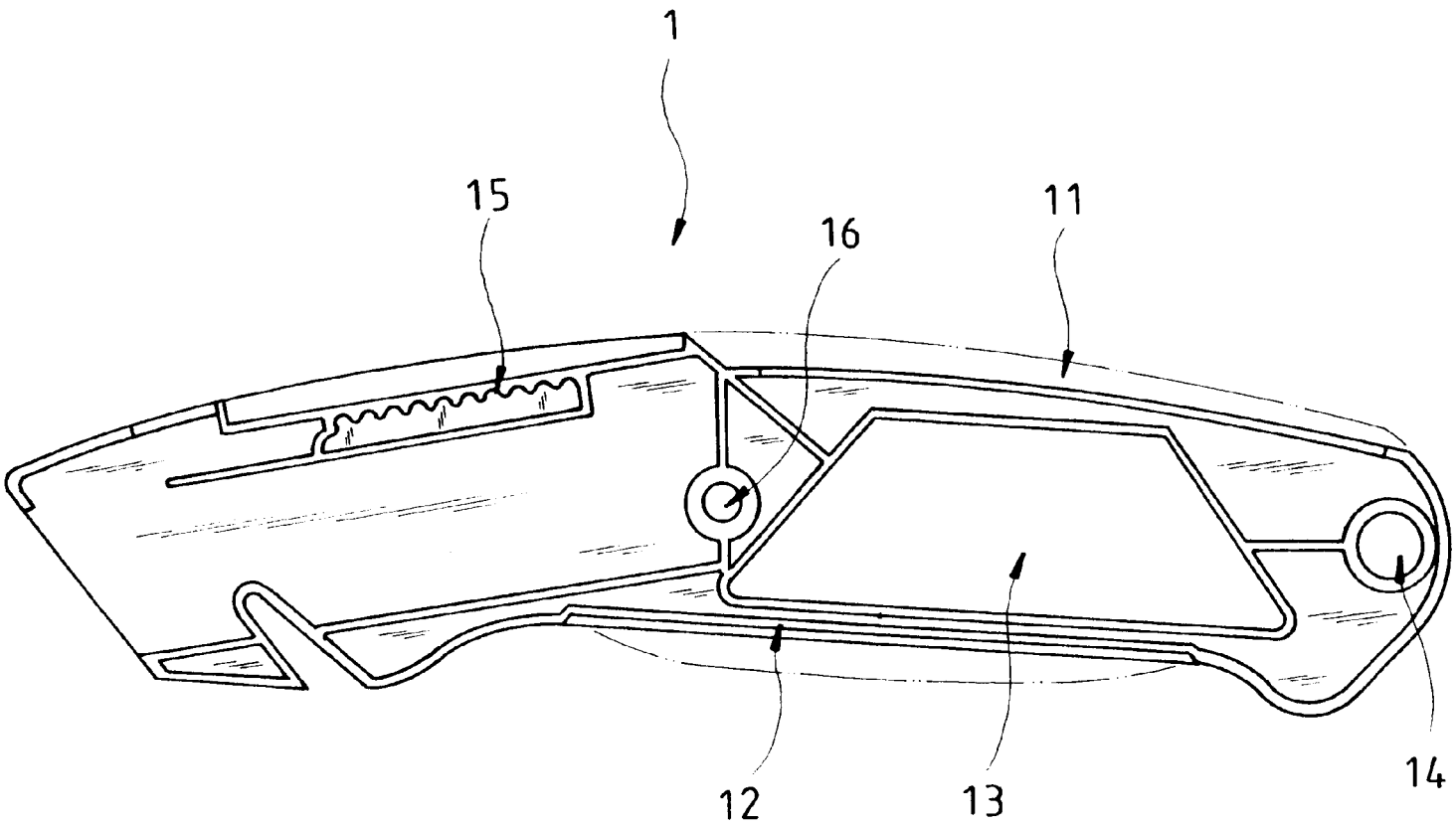
FIG. 9 is an orthographic drawing of the invention herein that shows the interior side of the front cover 1.

Referring to FIG. 1 and FIG. 2, the improved structure art design knife of the invention herein is comprised of a front cover 1, a rear cover 2, an upper support cushion 3, a lower support cushion 4, a blade magazine section 5, and a blade arrestor section 6, of which:

The front cover 1, as indicated in FIG. 9, the said front cover 1 is a casing of one-piece construction, the front cover 1 having, an elongated opening 11 formed along the rear section of its top edge as well as an elongated opening 12 along the rear section of its bottom section, and the front cover 1 also has a trapezoid-shaped opening 13 formed in the side of its rear section; furthermore, a hole 14 is formed through the tail end of the front cover 1, a wave-contoured stepped slot 15 is disposed inside the upper anterior section of the said front cover 1 and, furthermore, a threaded hole 16 is formed at the center of the front cover 1.

The rear cover 2 is a casing of one-piece construction, the rear cover 2 having an elongated opening 21 formed along the rear section of its top edge as well as an elongated opening 22 along the rear section of its bottom section, and the rear cover 2 also has a round opening 23 formed in the side of its rear section; furthermore, a hole 24 is formed through the tail end of the rear cover 2 and, furthermore, a threaded hole 25 is formed at the center of the rear cover 2.

The upper support cushion 3 is unitarily constructed of a soft plastic material that further increases both wielding comfort and stability.

The lower support cushion 4 is also unitarily constructed of a soft plastic material that further increases both wielding comfort and stability.

Figure 11:
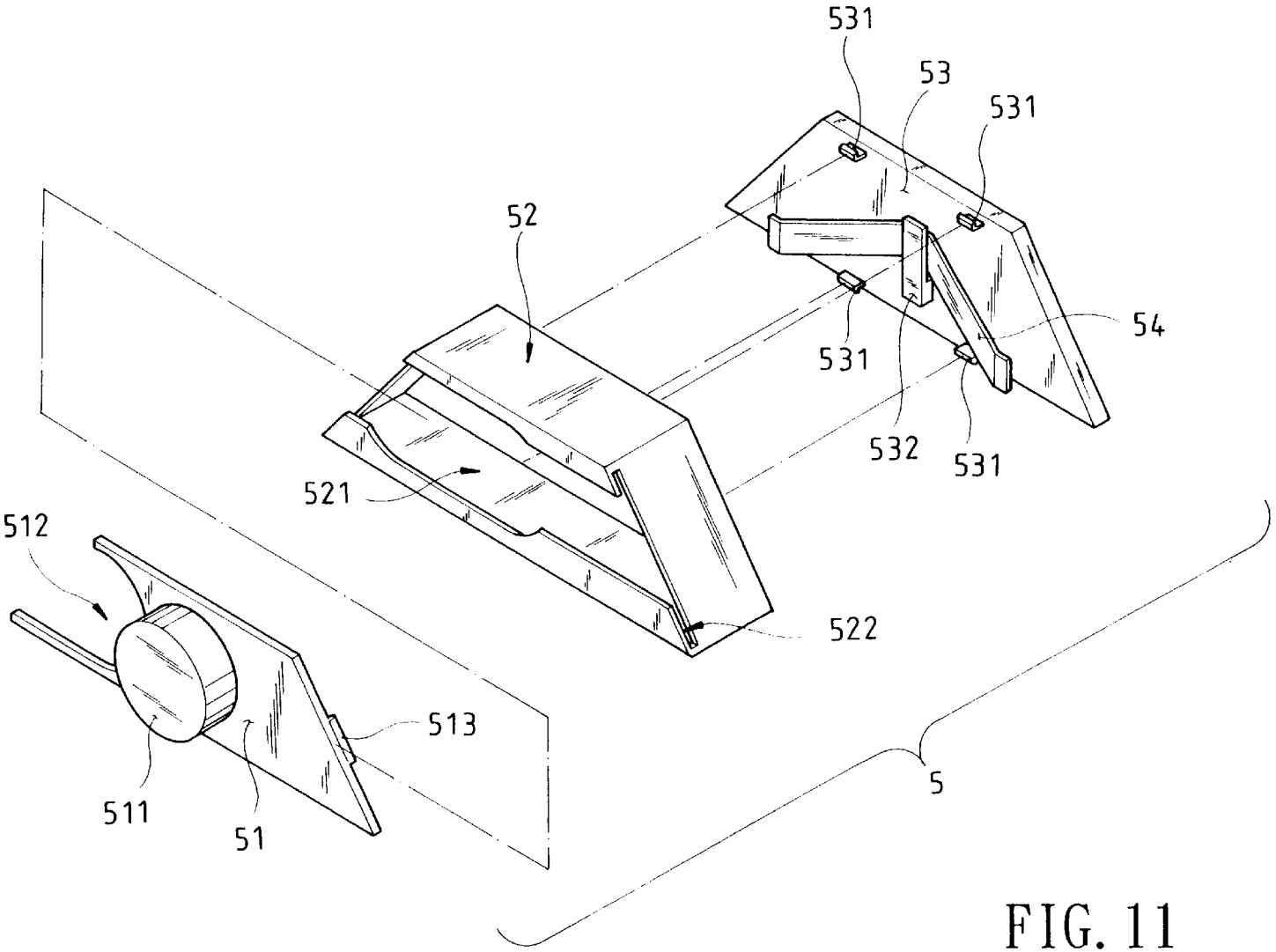
FIG. 11 is an exploded drawing of the blade magazine section 5 of the invention herein.

The blade magazine section 5, as indicated in FIG. 11, consists of a blade magazine front cover plate 51, a blade magazine frame 52, and a blade magazine bottom cover plate 53, wherein:

The blade magazine front cover plate 51 has projecting from the center of its outer side a cylindrical nub 511; the said blade magazine front cover plate 51 has an arc-shaped indentation 512 formed in one side and a protruding block 513 at the center and inner lateral aspect of its other side.

The blade magazine frame 52 is of a trapezoidal hollow arrangement having at its center a holding chamber 521 for containing a quantity of spare blades and the said blade magazine frame 52 has slots 522 formed in the upper and lower edges of its front side.

The blade magazine bottom cover plate 53 is of a trapezoidal planar arrangement having formed at both the upper and lower aspects of one side four hook tabs 531 and, furthermore, situated at the center of the same side is an L-shaped stay 532, the said stay 532 retaining an inserted V-shaped spring 54.

The blade magazine front cover plate 51 is inserted into the slots 522 formed in the upper and lower edges at the front side of the blade magazine frame 52, a quantity of spare blades (not shown in the drawings) are placed into the rear side of the blade magazine frame 52, and the blade magazine bottom cover plate 53, by means of its four hook tabs 531, is fitted over the rear side of the blade magazine frame 52 to assemble the blade magazine section 5; the spring 54 on the said blade magazine bottom cover plate 53 forces the quantity of spare blades tightly against the blade magazine front cover plate 51 such that when the user pushes the cylindrical nub 511 at the outer side and center of the blade magazine front cover plate 51 in the direction of the arc-shaped indentation 512, the protruding block 513 of the blade magazine front cover plate 51 ejects the spare blade closest to the blade magazine front cover plate 51 out of the blade magazine section 5, thereby providing for the dispensing of spare blades.

Figure 3:
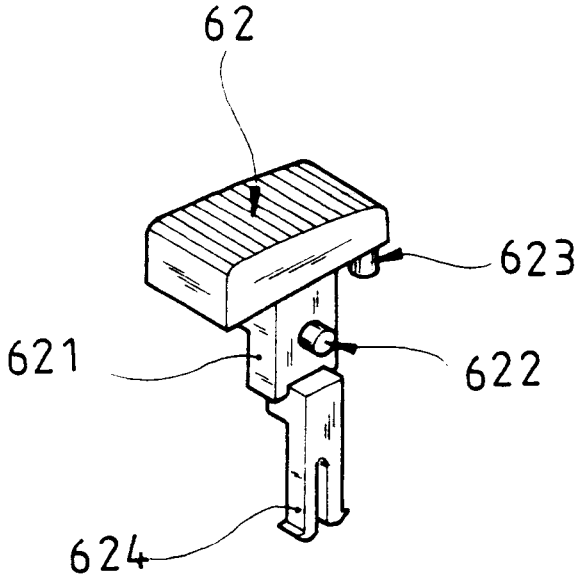
FIG. 3 is an isometric drawing of the push button 62 of the invention herein.
Figure 4:
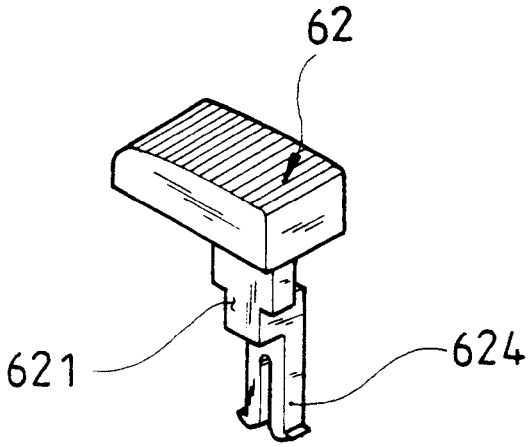
FIG. 4 is an isometric drawing of the push button 62 of the invention herein.

The blade arrestor section 6 consists of a blade mount 61, a push button 62, and a blade changing key 63, wherein:

The push button 62, as indicated in FIG. 3 and FIG. 4, has a columnar post 622 at the center of one side of its push button body 621 as well as a columnar post 623 formed at the lower lateral extent of its front edge and, furthermore, a pair of hooked clips 624 is disposed at the lower extent of the push button 62.

Figure 5:
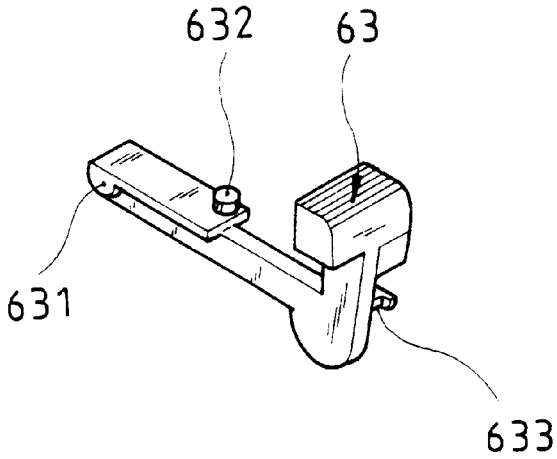
FIG. 5 is an isometric drawing of the blade changing key 63 of the invention herein.
Figure 6:
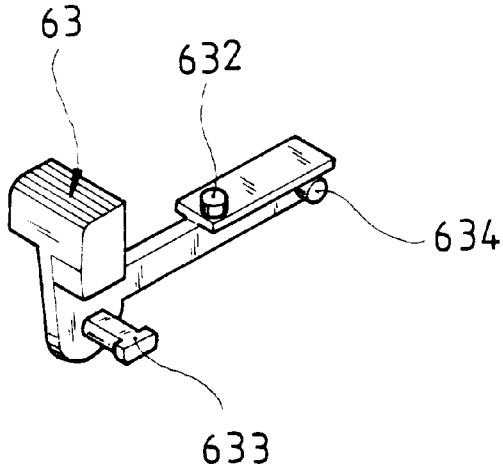
FIG. 6 is an isometric drawing of the blade changing key 63 of the invention herein.

The blade changing key 63, as indicated in FIG. 5 and FIG. 6, has semicircular lock tabs 631 at the front end and bottom edge of one side; a columnar post 632 projects from the center of the upper edge of the said blade changing key 63, a support shaft 633 projects from the tail end of one side on the blade changing key 63 and, furthermore, a columnar post 634 is disposed at the front end and bottom edge on the other side of the blade changing key 63.

Figure 7:
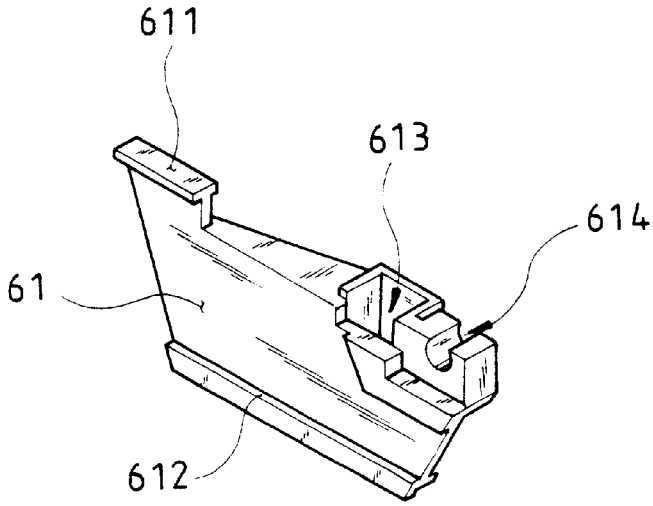
FIG. 7 is an isometric drawing of the blade mount 61 of the invention herein.
Figure 8:
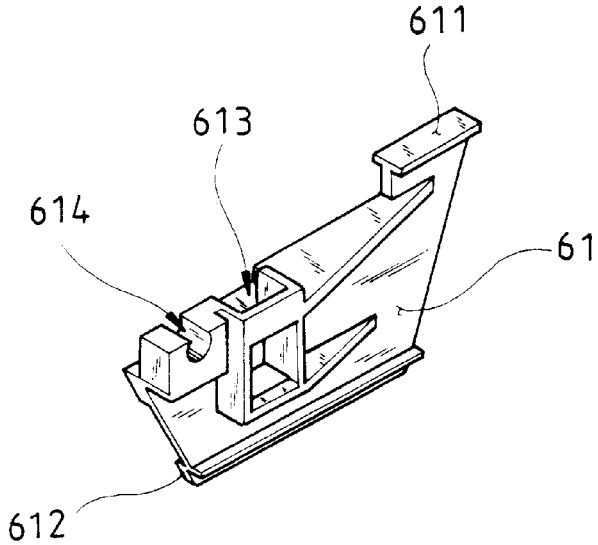
FIG. 8 is an isometric drawing of the blade mount 61 of the invention herein.

The blade mount 61, as indicated in FIG. 7 and FIG. 8, has a T-shaped insertion element 611 at the upper edge of its front end and another insertion element 612 at its lower edge; a rectangular opening 613 is formed in the center of the said blade mount 61 and, furthermore, a semicircular support shaft hole 614 is formed in the upper edge at the tail end of the said blade mount 61.

Figure 10:
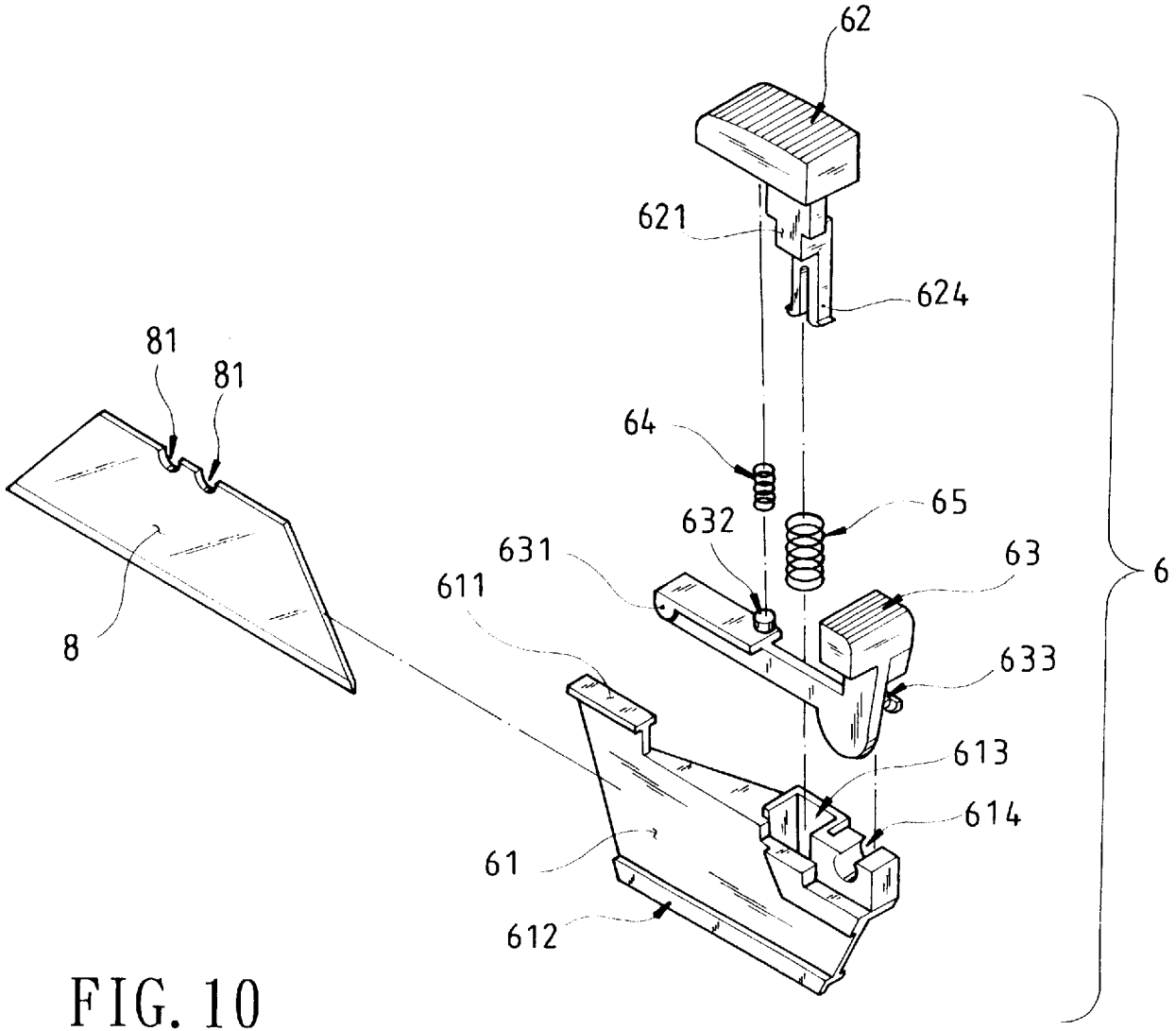
FIG. 10 is an exploded drawing of the blade arrestor section 6.

Referring to FIG. 10, the said blade arrestor section 6 consists of the support shaft 633 at the tail end of one side on the blade changing key 63 fitted into the semicircular support shaft hole 614 formed in the upper edge at the tail end of the said blade mount 61, the columnar post 623 of the said push button 62 is conjoined to the columnar post 632 projecting from the center of the said blade changing key 63 by means of a coil spring 64 ensleeved in between them and, furthermore, the hooked clips 624 disposed at the lower extent of the said push button 62 are slipped into a coil spring 65 and then inserted into the rectangular opening 613 of the said blade mount 61 where they are fixed into position; semicircular engagement notches 81 along the top edge of the blade 8 ensconce the lock tabs 631 at the front end and bottom edge of one side of the blade changing key 631, thereby completing the assembly of the blade arrestor section 6.

In the blade arrestor section 6 of the invention herein, the columnar post 622 at one side of the push button body 621 is inserted and fixed into the wave-contoured stepped slot 15 disposed inside the upper anterior section of the said front cover 1, the said release button 7 is secured against the upper edge at the front section of the front cover 1, the said upper support cushion 3 is fitted into the elongated opening 11 formed along the rear section of the top edge of the front cover 1, and the said lower support cushion 4 is fitted into the elongated opening 12 along the rear portion of the bottom section of the front cover 1; the rear cover 2 and the front cover 3 are then brought together, a screw 9 is inserted into the threaded hole 25 of the rear cover 2 and fastened into the threaded hole 16 of the front cover 1; and the said blade magazine section 5 is fitted into the trapezoid-shaped opening 13 in the front cover 1 to complete the entire assembly of the art design knife structure.

EMBODIMENTS OF THE INVENTION

Figure 12:
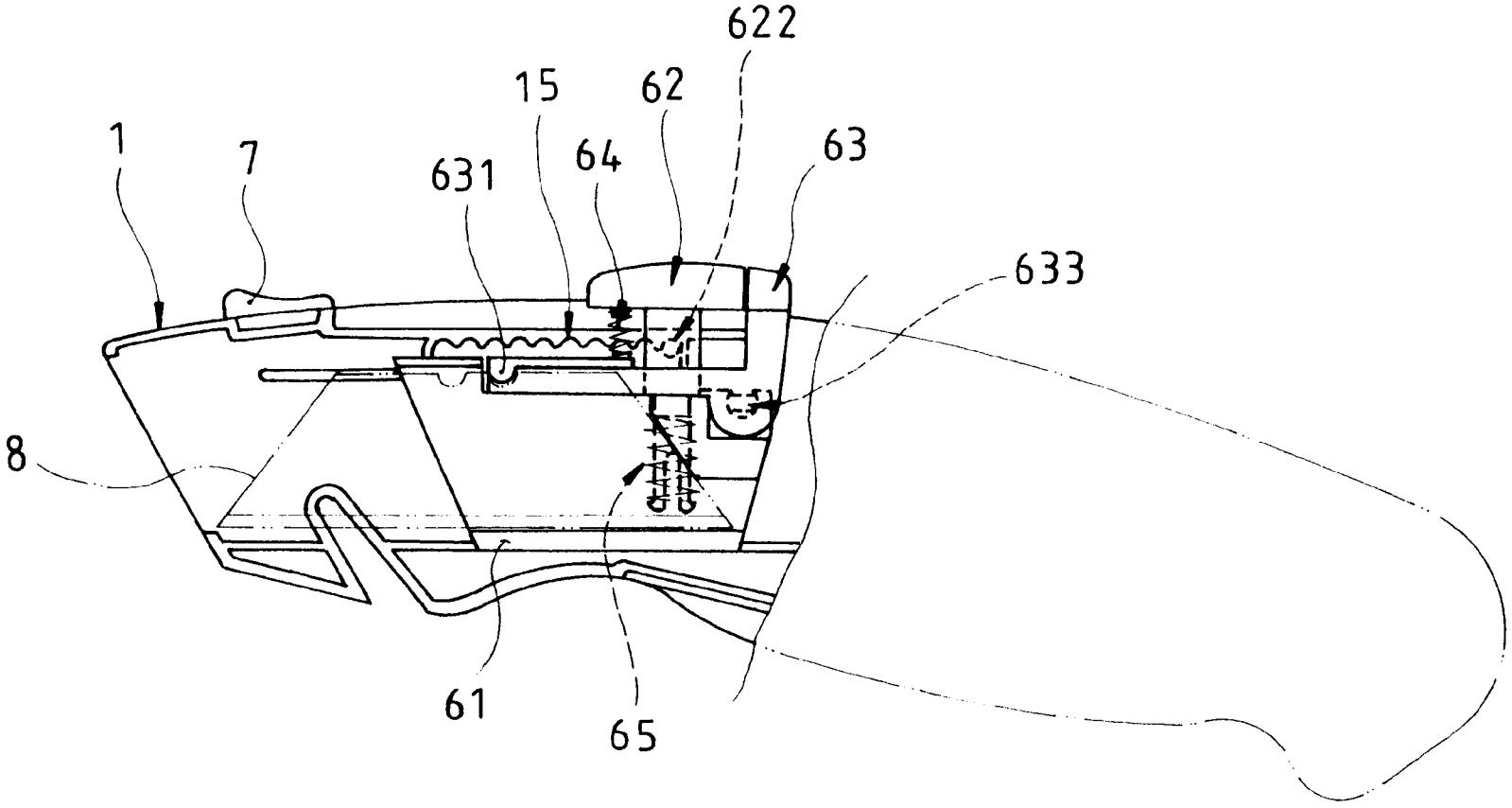
FIG. 12 is an orthographic drawing of the invention herein that illustrates the extension and retraction of the blade.
Figure 13:
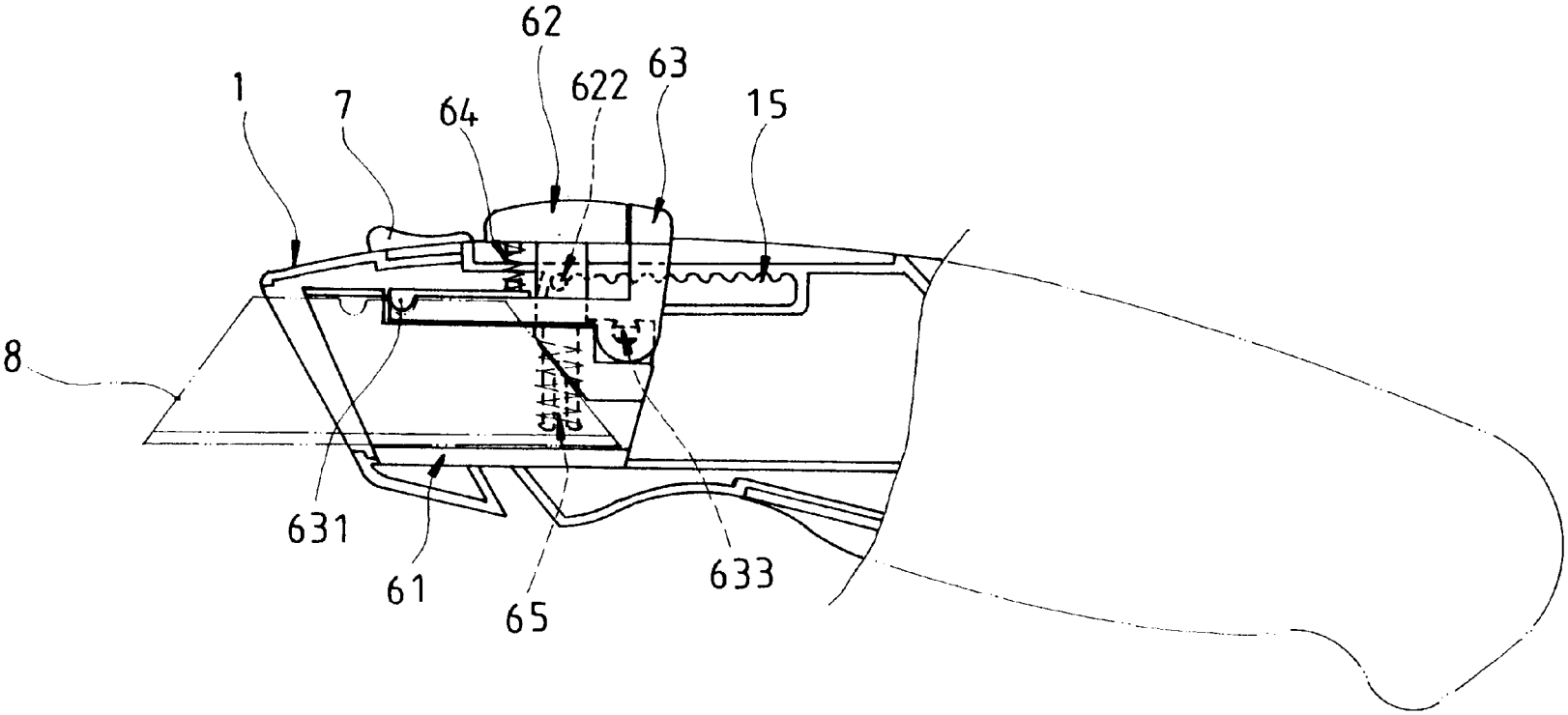
FIG. 13 is an orthographic drawing of the invention herein that illustrates the extension and retraction of the blade.

As indicated in FIG. 12, the columnar post 622 of the push button 62 in the invention herein is engaged in the wave-contoured stepped slot 15 and when the push button 62 is pressed downward, its columnar post 622 is disengaged from the wave-contoured stepped slot 15 and the push button 62 is driven outward, enabling the push button 62 to slide out the blade mount 61, the blade changing key 63, and the blade 8; the press button 62 is released when the blade 8 has been moved to the appropriate position, at which time the tension of the coil springs 64 and 65 shoves the push button 62 upward and the columnar post 622 becomes again engaged in the wave-contoured stepped slot 15, thereby achieving safe and stable blade operation, as indicated in FIG. 13; to fully retract the blade 8, the push button 62 is operated according to the reverse sequence of the above procedure.

Figure 14:
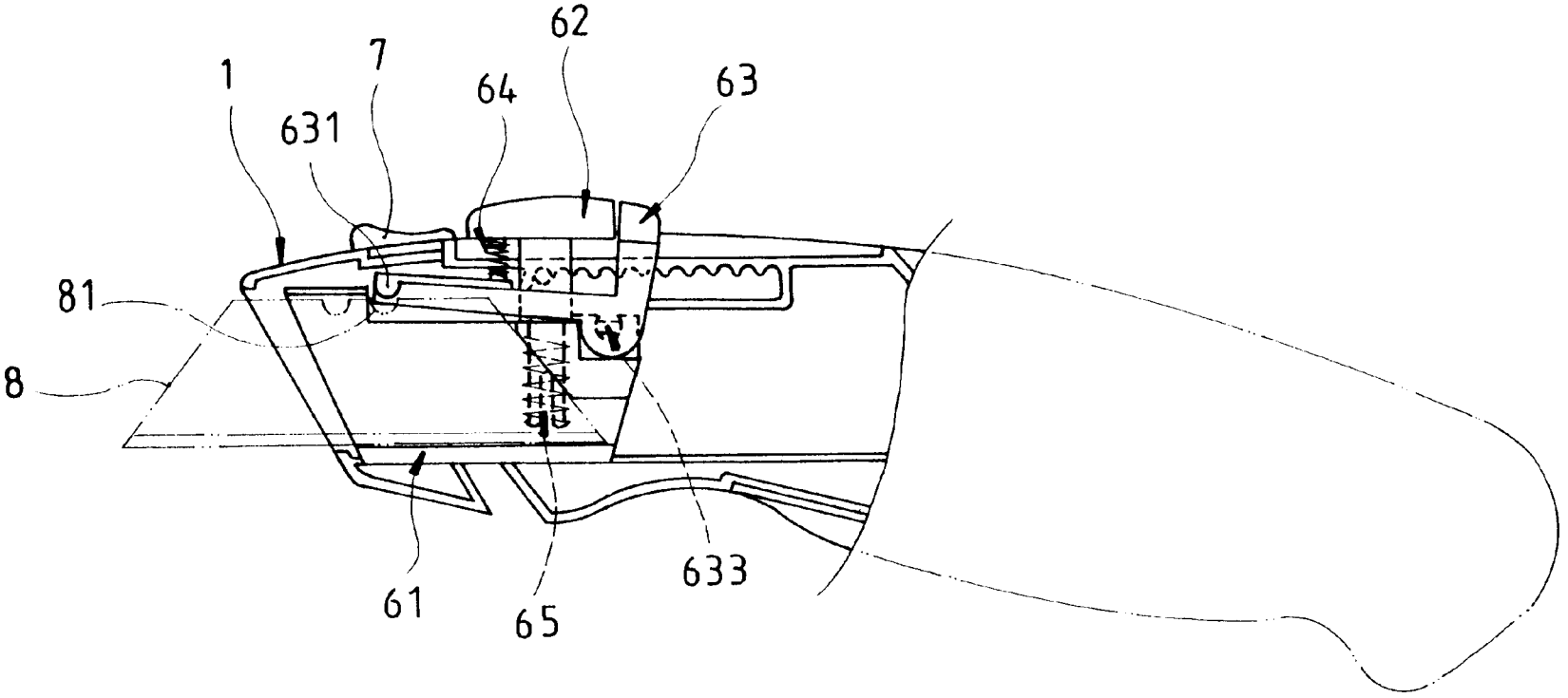
FIG. 14 is an orthographic drawing of the invention herein that illustrates the withdrawal of the blade during replacement.

To replace a blade, referring to FIG. 14, when the blade 8 has been pushed outside the body of the art design knife, the blade changing key 63 is pressed down and with the support shaft 633 of the said blade changing key 63 serving as an axis of sway, the lock tabs 631 at the front end of the blade changing key 63 are extricated from the engagement notches 81 of the blade 8, allowing the removal of the blade 8 and the placement of a new blade into the body of the art design knife; the blade changing key 63 is then released and the tension of the coil spring 64 is sufficient enough to secure the lock tabs 631 of the blade changing key 63 back into the engagement notches 81 of the blade 8, which completes the blade replacement operation.

In summation of the foregoing section, since the present invention is capable of achieving its claimed objectives and, furthermore, the disclosed structure possesses exceptional practical value and functions, the invention herein is submitted to the examination committee for review and the granting of the commensurate patent rights.

What is claimed is:

1. An improved structure art design knife of the invention herein comprised of a front cover, a rear cover, an upper support cushion, a lower support cushion, a blade magazine section, and a blade arrestor section, of which:

The said front cover is a casing of one-piece construction, the said front cover having an elongated opening formed along the rear section of its top edge as well as an elongated opening along the rear section of its bottom section, and the said front cover also has a trapezoid-shaped opening formed in the side of its rear section; furthermore, a hole is formed through the tail end of the said front cover, a wave-contoured stepped slot is disposed inside the upper anterior section of the said front cover and, furthermore, a threaded hole is formed at the center of the front cover, The said rear cover is a casing of one-piece construction, the said rear cover having an elongated opening formed along the rear section of its top edge as well as an elongated opening along the rear section of its bottom section, and the said rear cover also has a round opening formed in the side of its rear section; furthermore, a hole is formed through the tail end of the said rear cover and, furthermore, a threaded hole is formed at the center of the said rear cover, The said upper support cushion is unitarily constructed of a soft plastic material, The said lower support cushion is also unitarily constructed of a soft plastic material, The said blade magazine section consists of a blade magazine front cover plate, a blade magazine frame, and a blade magazine bottom cover plate, wherein the said blade magazine front cover plate has projecting from the center of its outer side a cylindrical nub; the said blade magazine front cover plate has an arc-shaped indentation formed in one side and a protruding block at the center and inner lateral aspect of its other side; the said blade magazine frame is of a trapezoidal hollow arrangement having at its center a holding chamber for containing a quantity of spare blades and the said blade magazine frame has slots formed in the upper and lower edges of its front side; the said blade magazine bottom cover plate is of a trapezoidal planar arrangement having formed at both the upper and lower aspects of one side four hook tabs and, furthermore, situated at the center of the same side is an L-shaped stay, the said stay retaining an inserted V-shaped spring; the said blade magazine front cover plate is inserted into the said slots formed in the upper and lower edges at the front side of the said blade magazine frame, a quantity of spare blades are placed into the rear side of the said blade magazine frame, and the said blade magazine bottom cover plate, by means of its said four hook tabs, is fitted over the rear side of the said blade magazine frame to assemble the said blade magazine section, The said blade arrestor section consists of a blade mount, a push button, and a blade changing key, wherein the said push button has a columnar post at the center of one side of its push button body as well as a columnar post formed at the lower lateral extent of its front edge and, furthermore, a pair of hooked clips is disposed at the lower extent of the said push button; the said blade changing key has semicircular lock tabs at the front end and bottom edge of one side; a columnar post projects from the center of the upper edge of the said blade changing key, a support shaft projects from the tail end of one side on the said blade changing key and, furthermore, a columnar post is disposed at the front end and bottom edge on the other side of the said blade changing key; the said blade mount has a T-shaped insertion element at the upper edge of its front end and another insertion element at its lower edge; a rectangular opening is formed in the center of the said blade mount and, furthermore, a semicircular support shaft hole is formed in the upper edge at the tail end of the said blade mount; the said blade arrestor section consists of the said support shaft at the tail end of one side on the said blade changing key fitted into the said semicircular support shaft hole formed in the upper edge at the tail end of the said blade mount, the said columnar post of the said push button is conjoined to the said columnar post projecting from the center of the said blade changing key by means of a coil spring ensleeved in between them and, furthermore, the said hooked clips disposed at the lower extent of the said push button are slipped into a coil spring and then inserted into the said rectangular opening of the said blade mount where they are fixed into position; semicircular engagement notches along the top edge of a blade ensconce the said lock tabs at the front end and bottom edge of one side of the said blade changing key, thereby completing the assembly of the said blade arrestor section, The said columnar post of the said blade arrestor section at one side of the said push button body is inserted and fixed into the said wave-contoured stepped slot disposed inside the upper anterior section of the said front cover, the said release button is secured against the upper edge at the front section of the said front cover, the said upper support cushion is fitted into the said elongated opening formed along the rear section of the top edge of the said front cover, and the said lower support cushion is fitted into the said elongated opening along the rear portion of the bottom section of the said front cover; the said rear cover and the said front cover are then brought together, a screw is inserted into the said threaded hole of the said rear cover and fastened into the said threaded hole of the said front cover; the said blade magazine section is fitted into the said trapezoid-shaped opening in the said front cover to complete the entire assembly of the art design knife structure.

* * * * *